United States Patent [19]

Lamort

[11] Patent Number: 4,828,689

[45] Date of Patent: May 9, 1989

[54] PURIFIER SCREEN OF NON-WELDED MANUFACTURE

[76] Inventor: Pierre Lamort, Rue de la Juiverie, Vitry en Perthois, France, 51300

[21] Appl. No.: 164,095

[22] Filed: Mar. 4, 1988

[30] Foreign Application Priority Data

Mar. 13, 1987 [FR] France ..... 87 03448

[51] Int. Cl.[4] ..... B01D 25/14

[52] U.S. Cl. ..... 209/393; 209/395; 209/273; 209/406; 29/450; 210/232; 210/488; 210/497.01

[58] Field of Search ..... 29/450; 210/232, 485, 210/488, 497.01; 209/270, 274, 393, 395, 406, 273, 392

[56] References Cited

U.S. PATENT DOCUMENTS

| | | | |
|---|---|---|---|
| 135,608 | 2/1873 | Vandegrift | 209/395 X |
| 1,362,334 | 12/1920 | Marcy | 209/395 X |
| 1,414,132 | 4/1922 | Hurrell | 209/393 X |
| 1,770,977 | 7/1930 | Fowden | 209/395 X |
| 2,346,647 | 4/1944 | Bennison | 210/497.1 X |
| 3,381,355 | 5/1968 | Bixby | 209/395 X |
| 4,374,169 | 2/1983 | Gryskiewicz et al. | 209/392 X |

FOREIGN PATENT DOCUMENTS

| | | | |
|---|---|---|---|
| 13493 | 2/1902 | Austria | 209/393 |
| 678506 | 9/1966 | Belgium | 210/497.01 |
| 307958 | 9/1955 | Switzerland | 210/488 |
| 859520 | 9/1981 | U.S.S.R. | 210/485 |
| 30303 | of 1909 | United Kingdom | 210/488 |
| 173999 | 1/1922 | United Kingdom | 209/393 X |

*Primary Examiner*—Robert B. Reeves
*Assistant Examiner*—Gary C. Hoge
*Attorney, Agent, or Firm*—Darby & Darby

[57] ABSTRACT

A screen for a purifier or separator, especially for a paper pulp purifier embodied by assembly of parallel bars on crosspieces, the assembly being made without welds on the crosspieces by dovetailed notches being borned by the bars, the lips of the notches fitting in V-shaped lateral grooves borne by each of the crosspieces, characterized in that the bars (6) comprise, laterally, on at least one side (6a, 6b) at least one recess (10) so that the width of the bar is diminished at the level of the recess (10) by the recessed depth, and in that the bars are mounted in juxtaposition on the crosspieces (7), in contact against one another by their non-recessed parts.

5 Claims, 2 Drawing Sheets

PURIFIER SCREEN OF NON-WELDED MANUFACTURE

The present invention relates to purifiers or separators, and especially to purifiers of paper pulp of the type incorporating one or more slotted or perforated screens.

In a prior application, FR No. 84,17189, the Applicant described a slotted screen embodied by the assembly of parallel bars on crosspieces. The assembly was made without welds by means of a first notch borne by the bars entering a V-shaped groove borne by the crosspiece, the crosspiece bearing second notches for positioning the bars to hold them firmly in place and obtain slots of a very precise width between bars.

Such screens can be flat, with a plurality of elementary screening surfaces, or cylindrical with a circular or polygonal section, the bars being parallel to the axis of the cylinder, and the crosspieces perpendicular to this axis. In the latter case, in order to close the cylinder, the end of the crosspieces have, over a length of several positioning notches, a thickness on the order of half of the thickness in the central zone, so as to reconstitute the section of the crosspiece by superposition of the said ends, which are assembled and held in position by grip of the sides of the first notches on the bars.

In this type of screen the bars have a width on the order of 6 to 8 mm and the slot separating these bars can be very thin, on the order of a few tenths of a millimeter. It has been found very difficult in practice to obtain this precision, for a number of reasons:

it is very difficult to obtain bars of perfectly constant thickness, the positioning notches machined in the crosspieces can have a slight play, even a minimal one that allows slight displacement of the bars, in the machining of the crosspieces defects of positioning of the notches along the crosspieces can succeed one another and, as they accumulate, become substantial enough for the slots to vary in width.

This defect in the width of the slots results primarily in a mediocre quality of the screening, either because the fibers that are to be eliminated pass through the screen owing to the presence of too-wide slots, or, vice-versa, good fibers are held back and eliminated instead of passing through the screen.

It is the aim of the present invention to remedy these drawbacks and the subject thereof is a screen for a purifier or separator, especially a purifier of paper pulp of the type embodied, over at least a part of its surface, by an assembly of parallel bars on crosspieces, the assembly being embodied without welds on the crosspieces by dovetail notches borne by the bars, the lips of the said notches entering at least one V-shaped lateral groove borne by each of the crosspieces, the bars having, laterally, on at least one side, at least one recess so that the width of the bar is diminished at the level of the recess by the recessed depth, and in that the bars are mounted in juxtaposition on the crosspieces, in contact against one another by their nonrecessed parts.

The screen according to the invention is also remarkable for the following characteristics:

the bars comprise, laterally, at least two recesses, one on each side, and in that the bars are mounted so that each recess on a bar will be opposite the corresponding recess on the adjacent bar.

the bars have a T-shaped cross section, the notches being made longitudinally in the vertcal arm of the T, and the lateral recesses being made longitudinally at the ends of the arms of the said T.

in the transverse direction the bars are generally trapezoidal in form, the notches being made longitudinally on the small side of the trapezium, the recesses being made longitudinally on either side of the base of the said trapezium.

The screen comprises a closure bar differing in width from the other first ones, whose function is to insure the closure of the cylinder formed by the juxtaposition of the bars.

The invention also relates to the purifiers equipped with such screens and to the process of embodiment of such a screen or elementary screening surface consisting successively in:

bending the bars elastically at the level of the notches at an angle at least equal to the angle of taper of these notches, placing the bars on the crosspieces, straightening the bars gripping the crosspieces, juxtaposing the bars against one another by sliding them on the crosspieces, when the screen is cylindrical, embodying the closure of the cylinder by superposition of the ends of the crosspieces with a thickness reduced by half, and placement of the closure bar.

With this new embodiment process, the screen obtained has all of the slots perfectly identical and very precise in width, regardless of variations in the widths of the bars. As a matter of fact, since the recesses are made by milling or other known means from the supporting surface constituted by the border of the bar, their depth is very precise, and since the width of the slots is the sum of two opposing recesses it is likewise as precise.

For a better understanding of the invention, the attached drawing represents an example of embodiment of a screen according to the invention.

The figures illustrate the example of a cylindrical screen for a centripetal purifier; this, of course, is a nonlimiting example and the invention can be applied to centrifugal purifiers and to flat screens of any shape.

Figure 1:
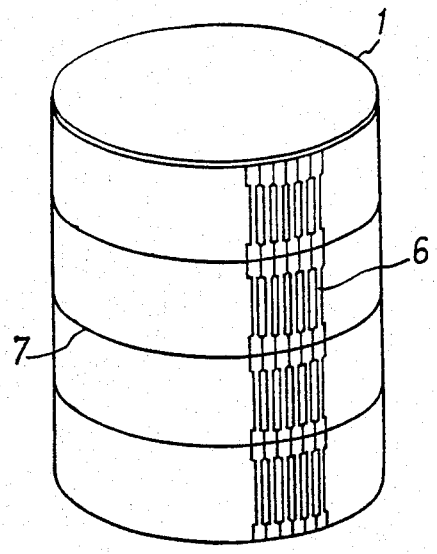
FIG. 1 is a schematic view in perspective of a cylindrical screen with a circular section according to the invention.

The screen 1 in FIG. 1 is embodied by the assembly of bars 6 and crosspieces 7. The bars are represented as directed along the generatrices of a cylinder whose crosspieces are the cross sections. Along their thickness 2, the bars 6 have dovetail notches 8. Crosspieces 7 have at least one lateral groove 9 with a V-shaped cross section in which a lip of notch 8 fits. The longitudinal section of notch 8 corresponds to the cross section of the crosspiece into which it enters.

As a result of this arrangement the bars are solidly assembled by the cooperation of notches 8 and the groove or grooves 9, while their positioning along the crosspiece or crosspieces remains free.

In the usual productions of such types of devices, the screens are often embodied by milling sheets of stainless steel 6 to 8 mm thick, to produce slots of a few tenths of a millimeter spaced parallel to one another by intervals on the order of a half centimeter.

With the method of embodiment of the invention it is possible to use bars 6 of a width 3 similar to the above said intervals (about ½ cm) and a thickness 2 that is likewise similar (6 to 8 mm), assembled by crosspieces 7 of an appropriate thickness.

When a cylindrical screen is made, the crosspieces 7 have to be bent and their ends assembled. The assembly described in the said patent also makes it possible here to avoid welds: each end (*7a, 7b*) of a crosspiece has, over a length covered by several bars, its thickness diminished in the direction parallel to the bars so that the total of thicknesses *7a* and *7b* will be equal to the thickness of crosspiece 7. In order to hold the ends of the bars in place on one another, pins 4 are provided, parallel to bars 6, preferably in the part of the crosspiece fitting in the notch in the bar so that when the bars are put in place, the pins will be imprisoned by the bars and the locking of the assembly is complete.

The bars 6 have a cross section in the general shape of a T (FIGS. 3, 6, 7, 8), the notch 8 being made in the vertical median arm of the T.

Figure 2:
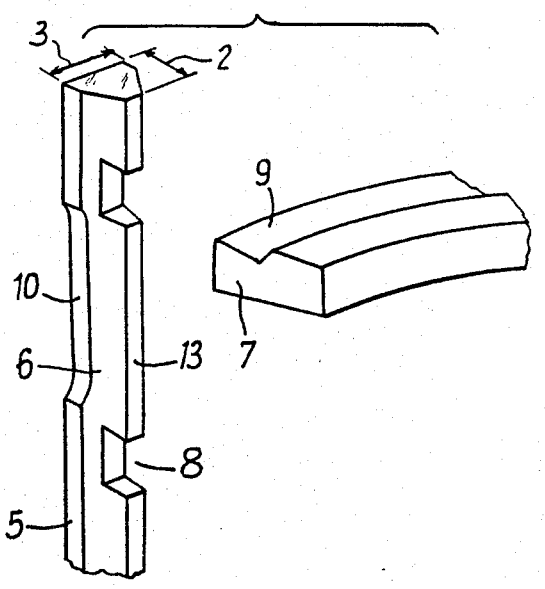
FIG. 2 is a schematic view in perspective illustrating the assembly of a bar on a crosspiece.
Figure 4:
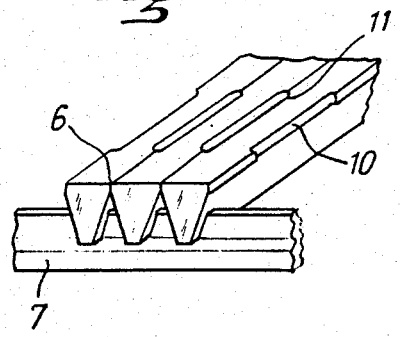
FIG. 4 is a variation of the surface in FIG. 3, with trapezoidal bars.

According to a variation of embodiment, the cross section of the bars has a generally trapezoidal form (FIGs. 2 and 4) the notch 8 being made in the small side 13.

In all the variations of embodiment the lateral borders 5 of the bars 6 are parafectly parallel to one another over their entire length so that on juxtapositioning two adjacent bars 6 the borders 5 will be in contact against one another.

The bars comprise laterally, on at least one side, at least one recess 10 so that the width 3 of the bar is diminished at the level of the recess or recesses, by the recessed depth.

The bars 6 thus recessed are assembled on the crosspieces 7 and juxtaposed against one another by their lateral borders 5 abutting where non-recessed.

The recesses, preferably produced by milling, can be made over greater or lesser distances and they are placed along the lateral borders so that the juxtaposition of two bars gives rise to at least one slot 12 or a perforation 14, depending on the length of the milling.

Figure 3:
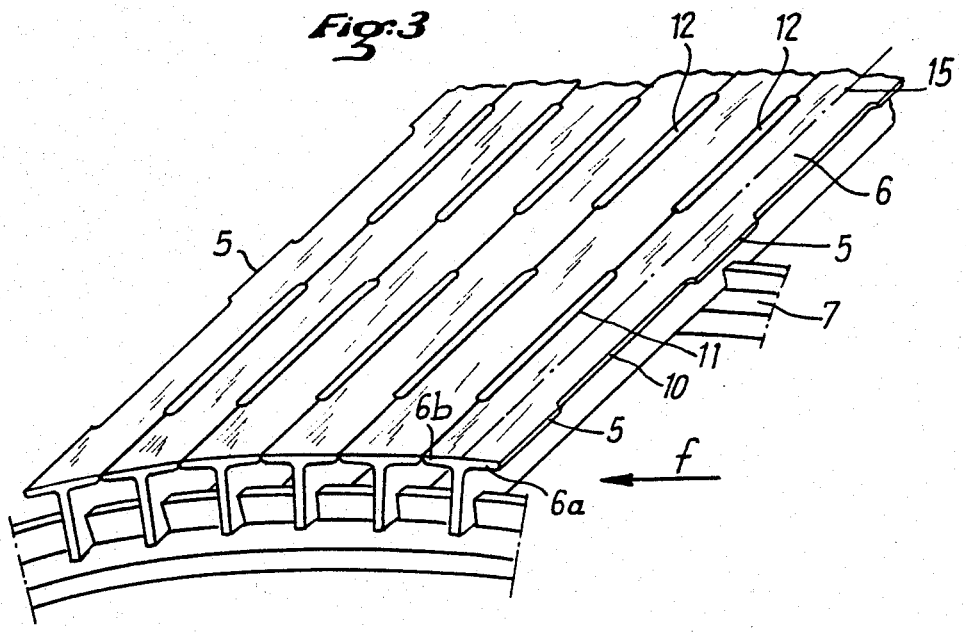
FIG. 3 is a schematic view in perspective of a screening surface according to the invention equipped with T-shaped bars.

For example, in the first form of embodiment illustrated in FIG. 3, the bars are T-shaped and the recesses 10, 11 are formed on either side at the ends *6a, 6b* of the two horizontal arms, symmetrioally to the longitudinal axis 15.

It is also possible to form recesses on just one side, the slot being either obtained by juxtaposition of a recess (20) against an adjacent bar that is not recessed, or by juxtaposition of two recesses 21, 22, and in this case the slots succeed one another on every two bars.

Figure 5:
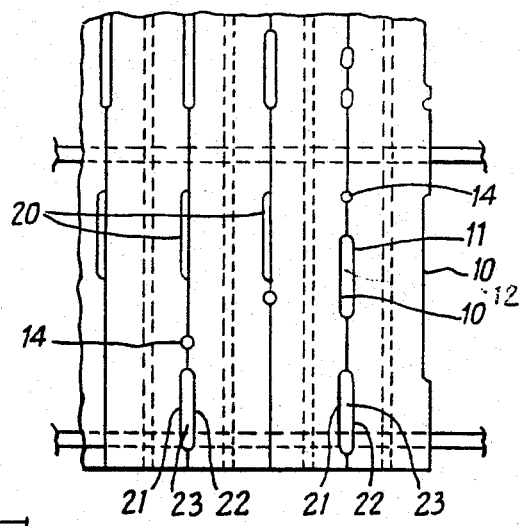
FIG. 5 is a plan view of a portion of a screen according to the invention with assymetrical recesses and alternation of perforations and slots.
Figure 6:
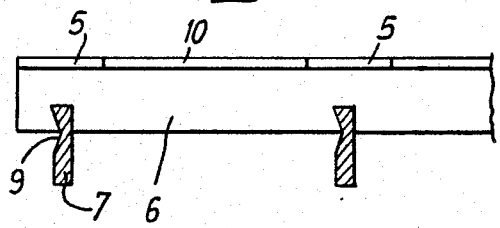
FIG. 6 is a profile view along line F in FIG. 3.
Figure 7:
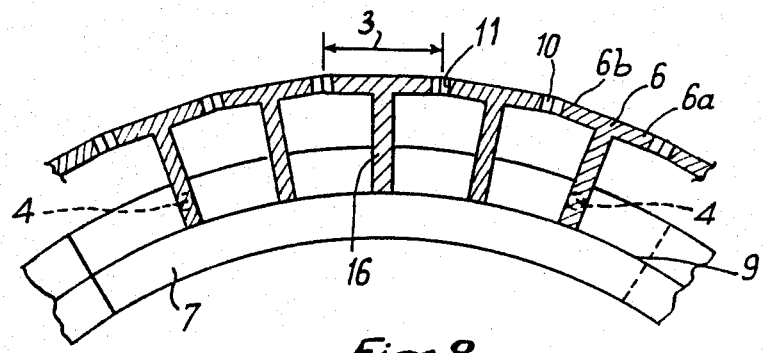
FIGS. 7 and 8 illustrate the method of closure of a cylindrical screen.
Figure 8:
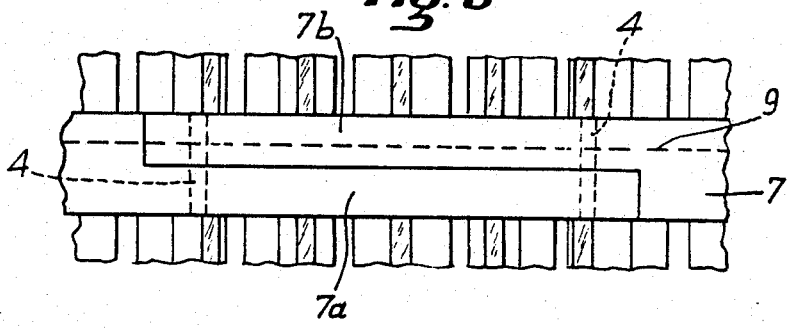

It is possible, of course, to combine bars having recesses of different lengths in a given screen so that the screen will exhibit slots and/or perforations, regularly or irregularly spaced (FIG. 5).

The screen thus constituted by juxtaposition of bars makes it possible to obtain a succession of slots 11 of the same width, regardless of the interval between the slots. It is then possible to use bars having irregularities in width relative to one another.

On closing the cylinder, owing to the practically inevitable presence of these irregularities, provision is made for the use of a closure bar 16, the characteristic of which is to be of a width 3 different from the others, this width being that of he interval remaining between the last two bars 6. This closure bar 16 can be wider or narrower than the others, but it is recessed identically.

The invention is also capable of receiving variations imparting certain improvements, for example the bars can have a nonsymmetrical cross section, some of them can have a greater thickness than the others, creating an obstacle here and there to break up the flow along the screen, or they can comprise a downstream spur, producing eddies to improve the functioning of the slots, etc.

The invention is not limited to forms of cylindrical screens of circular section; it is can apply, for example, to flat ones and to cylindrical screens of polygonal section, a closure bar being perhaps used with each face of the polygon, and the invention encompasses purifiers or other devices used in filtering, purification or separation, in particular for the manufacture of paper pulp comprising a filter according to the description above.

I claim:

1. Screen for a purifier or separator, especially for a purifier of paper pulp of the type embodied, over at least a part of its surface, by assembly of parallel bars on crosspieces, the assembly being made without welds on the crosspieces by dovetailed notches borne by the bars, the lips of the said notches fitting in at least one V-shaped lateral groove borne by each of the crosspieces, characterized in that the bars (6) comprise, laterally, on at least one side (*6a, 6b*) at least one recess (10) so that the width (3) of the bar is diminished at the level of the recess (10) by the depth recessed, and in that the bars are mounted in juxtaposition on the crosspieces (7), in contact against one another by their non-recessed parts.

2. Screen according to claim 1, characterized in that the bars (6) comprise, laterally, at least two recesses (10, 11), one on each side, and in that the bars are mounted so that each recess (10) on a bar (6) will be opposite the corresponding recess (11) on the adjacent bar.

3. Screen according to claim 1, characterized in that the bars (6) have a T-shaped cross section, the notches (8) being formed longitudinally in the vertical arm of the T, and the lateral recesses (10, 11) being formed longitudinally at the ends (*6a, 6b*) of the arms of the said T.

4. Screen according to claim 1, characterized in that the bars are transversely in the general form of a :rapezoid, the notches (8) being formed longitudinally on the small side of the trapezium (13), the recessed being formed longitudinally on each side of the base of the trapezium.

5. A screen according to claim 1, characterized in that it is cyindrical, and comprises a closure bar (16) of a width (3) different from that of the other, first ones (6), whose .function is to insure the closure of the cylinder formed by the juxtaposition of the bars.

* * * * *